United States Patent [19]

Himmel

[11] 4,180,255

[45] Dec. 25, 1979

[54] WIPER SYSTEM INSERTER

[75] Inventor: Ronald G. Himmel, Parma, Ohio

[73] Assignee: Harris Corporation, Cleveland, Ohio

[21] Appl. No.: 864,325

[22] Filed: Dec. 27, 1977

[51] Int. Cl.[2] ..... B65H 39/10

[52] U.S. Cl. ..... 270/54; 271/277

[58] Field of Search ..... 270/54–58; 271/82, 277; 101/229, 296

[56] References Cited

U.S. PATENT DOCUMENTS

| | | | |
|---|---|---|---|
| 2,251,943 | 8/1941 | Kleineberg | 270/54 |
| 2,413,358 | 12/1946 | Kleineberg | 270/54 |
| 3,809,384 | 5/1974 | Zugel | 270/54 |

*Primary Examiner*—Edgar S. Burr
*Assistant Examiner*—A. Heinz

[57] ABSTRACT

A signature inserter for a saddle gathering machine including a rotatable extractor drum for extracting a signature from a hopper and carrying it to a stop position on the periphery of the drum. A reciprocating dipper contacts the lower cut edge of the signature and moves the cut edge into a gripping position beside a transfer drum. A wiper vane mounted for rotation in a path adjacent the extractor and transfer drums wipes the lower edge of the signature onto the dipper and then rotates away from the signature. Grippers associated with the transfer drum grip the lower edge of the signature and carry it away from the extractor drum toward an opener drum. The transfer drum and opener drum cooperate to spread the signature and deposit it upon a saddle.

6 Claims, 6 Drawing Figures

WIPER SYSTEM INSERTER

BACKGROUND OF THE INVENTION

This invention relates to saddle inserters utilizing rotating drums for extracting a signature and opening the signature into an inverted "V" shape for placement on a saddle gatherer prior to binding. The signatures, in the simplest form, are single sheets of paper folded in the middle so as to constitute four paper surfaces and may range to sixteen or more such sheets. Before the pages of the signatures can be bound, the halves, or laps, on the opposite sides of the fold must be spread so that the signatures can be assembled together and the folds of the signatures can be stapled or stitched.

In accomplishing this, grippers on an extractor cylinder or drum grip the endmost signature in a hopper by the folded edge and carry the signature around the drum to a stop position. When the signature is in position on the extractor drum, an oscillating "dipper" approaches the signature from the side toward the extractor drum and picks up the cut end of the signature and supports it so that grippers may grip it.

Grippers on a transfer drum then grip the lower cut end of the signature, pull it away from the extractor drum and carry it to an opener drum. As the folded signature descends between the opener and transfer drums, each half of the signature is clamped by means of vacuum and/or mechanical grippers associated with the drums. As the drums rotate in opposite directions, the signature laps are opened into an inverted "V" and released onto a saddle from which it is gathered together with other signatures and delivered to a saddle stitching machine for stapling.

When a signature is in the stop position on the extractor drum the cut or lapped edge of the signature must be contained so that the dippers can position it for grippers on the transfer drum to grip the lapped edge in preparation for carrying the signature around the transfer drum to the opener drum. Heretofore, such containing has been provided by a roller of relatively small diameter compared to that of the extractor and transfer drums positioned just above the nip between the two drums. An arrangement of this type is disclosed in U.S. Pat. No. 3,692,300.

While the roller performs the basic function of containing a signature, it also imposes upon the signature a rather severe and tortuous path in its travel from the extractor drum to the transfer drum.

Further, the cut edge of a signature tends to be deflected away from the dippers when first contacted thereby. Because of the small diameter of the roller and its close position to the nip between the extractor drum and transfer drum, the cut end of the signature below the roller may be deflected sharply when contacted by the dipper and tend to curl upwardly. In some cases the cut edge of the signature is gripped while in this condition which produces a fold at the cut edge with consequent malfunctions and paper jams.

SUMMARY OF THE INVENTION

It is an object of the present invention to provide improved means for containing and positioning the cut end of a signature which permits proper gripping and a smooth path for the signature between an extractor drum and a transfer drum of a signature inserter.

According to the present invention, a rotary wiper vane is mounted adjacent an extractor drum and transfer drum and the roller is eliminated. The wiper vane has a curved outer surface and is rotatable in a path above the nip between the extractor and transfer drum. As the dippers pick up and carry the cut end of the signature, the wiper vane moving in its path contains the cut end and wipes it smoothly onto the dipper surface. The vane then proceeds in its arcuate path out of the path of the signature and of other parts associated with the drums. The cut end of the signatures can be gripped securely and with no curls or creases to pull the signature in a smooth path onto the transfer drum.

Since the wiper vane is movable out of the way of the signature it can be positioned advantageously for its containing and wiping functions without imposing a distorted or tortuous path on the signatures. Because there is less signature path distortion it is possible to handle signatures having cards or other articles adhered or otherwise attached thereto without excessive risk of detachment of the cards. Further, because signatures have a smoother path, the transferring and opening of signatures can proceed at higher speeds.

DESCRIPTION OF A PREFERRED EMBODIMENT

Figure 1:
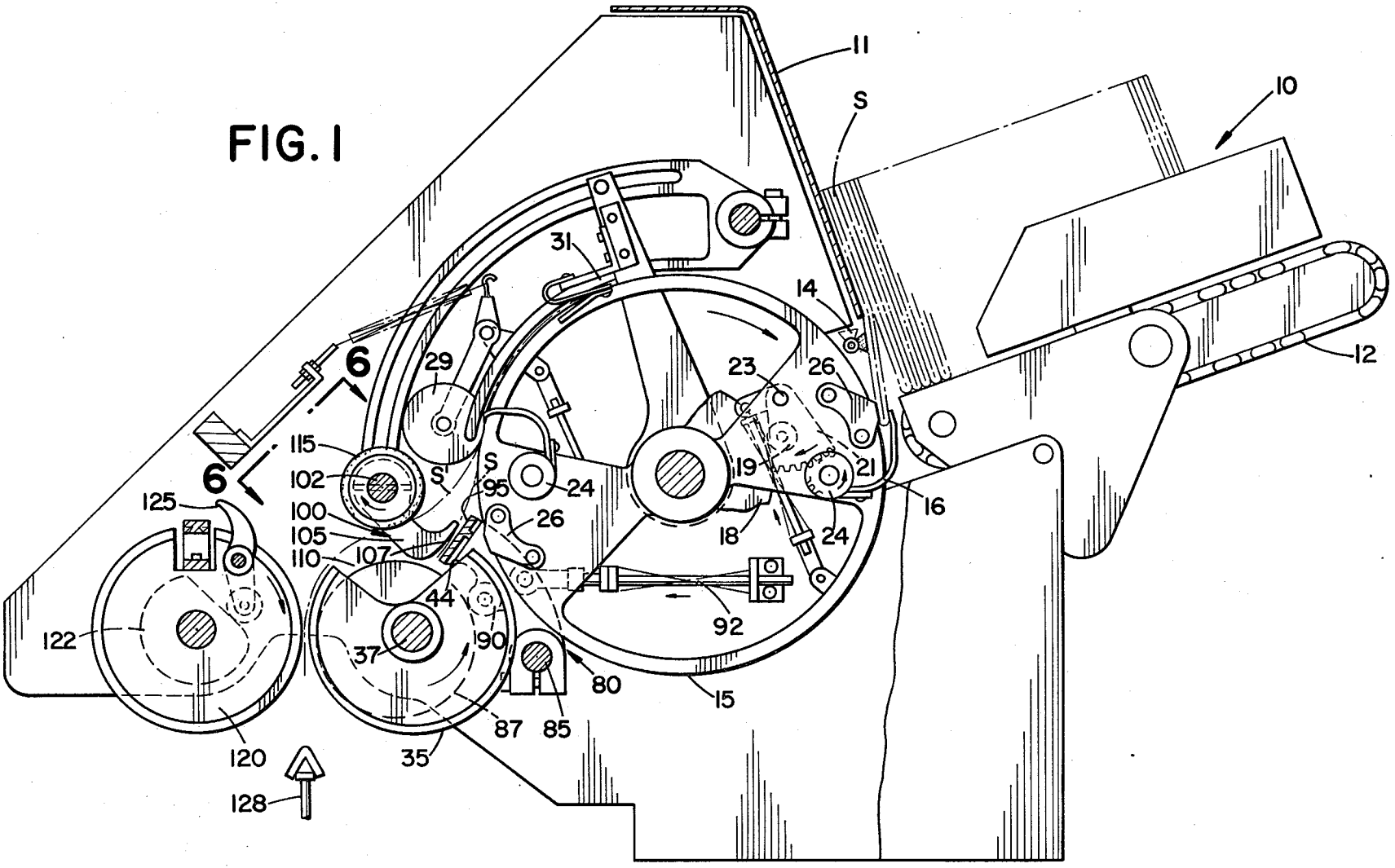
FIG. 1 is a side elevational view, partly in section, of apparatus embodying the present invention.

Referring now to the drawings and initially to FIG. 1, a hopper diagrammatically shown at 10 is loaded with signatures S in a vertical position. The signatures are supported by an end plate 11. The hopper includes an intermittently operated conveyor mechanism 12 which maintains the signatures against the end plate 11. The signatures are loaded in the hopper with their folded ends downwardly against the surface of the conveyor 12. A mechanism of this type is illustrated in U.S. Pat. No. 3,275,315.

The lowermost portion of the end plate 11 is spaced above the conveyor belt 13 to provide an opening into which vacuum suckers 14 intermittently move once for each feeding cycle to pull the endmost signature to the periphery of a rotatable extractor drum 15. Two sets of grippers 16 are spaced diametrically apart about the periphery of drum 15 and are operated by a cam 18. A cam roller 19 contacts cam 18 and causes a segment 21 to pivot about a pin 23. Teeth on the segment 21 mesh with those on wheel 24 of the gripper 16 and cause the gripper to close on a signature against the stop 26. During each cycle of the machine one set of grippers 16 closes on the folded edge of a signature and withdraws it from the hopper. The signature moves with the gripper as the drum 15 rotates in the direction indicated by the arrow. The signature is carried by the gripper to a guide roller 29 and then released to be moved between the guide roller 29 and drum 15 to a stop 31. At this point, the folded edge of the signature is against the stop 31 while the lower lapped or cut end is hanging vertically from the nip between guide roller 29 and drum 15.

Figure 2:
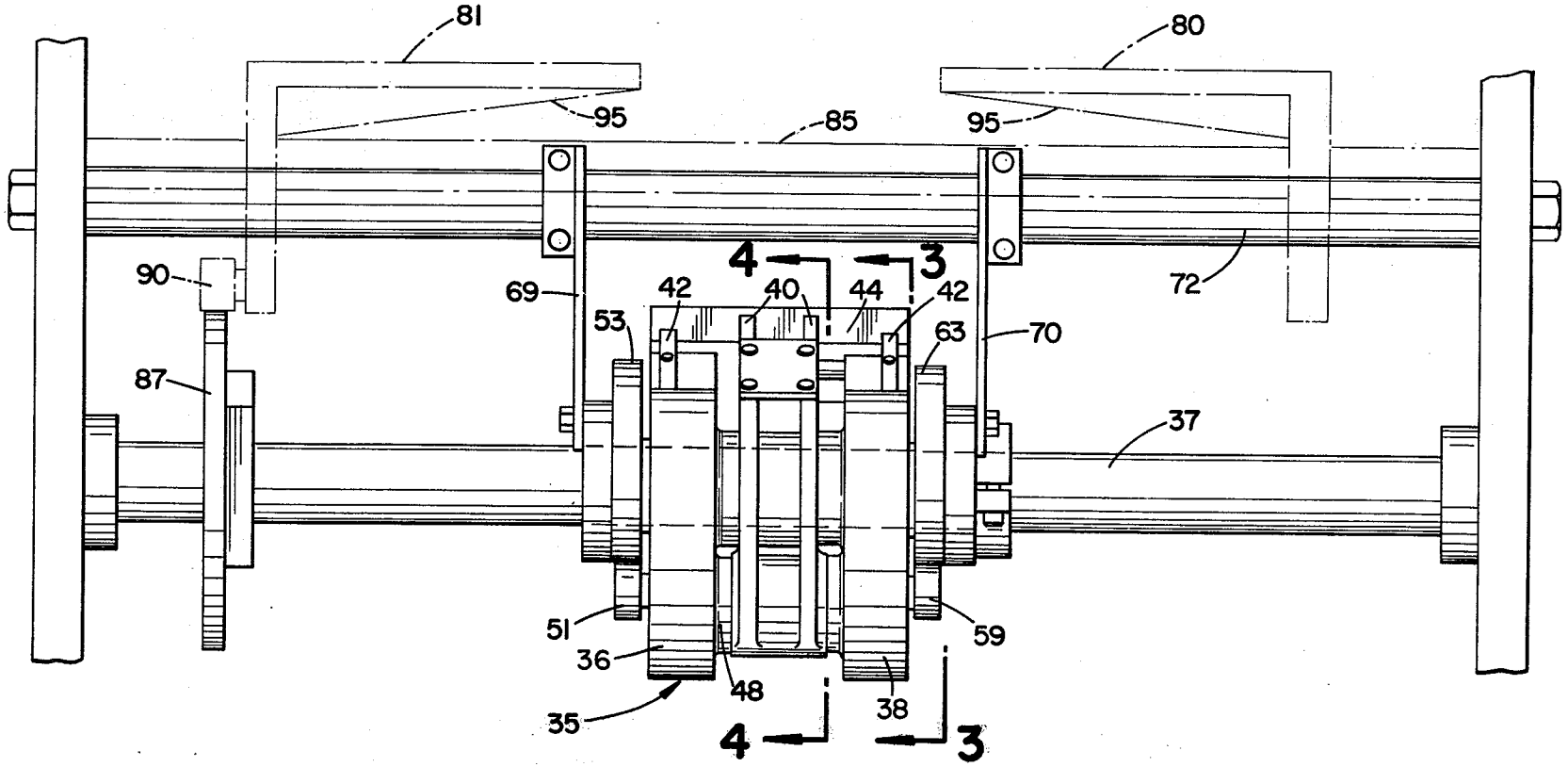
FIG. 2 is a plan view of the transfer drum and dippers in the apparatus of FIG. 1.
Figure 3:
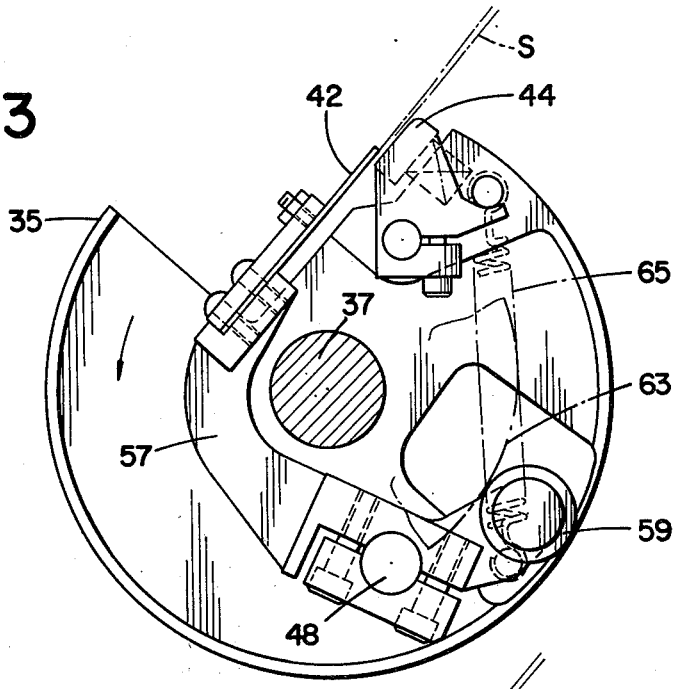
FIG. 3 is a view on the line 3—3 of FIG. 2.
Figure 4:
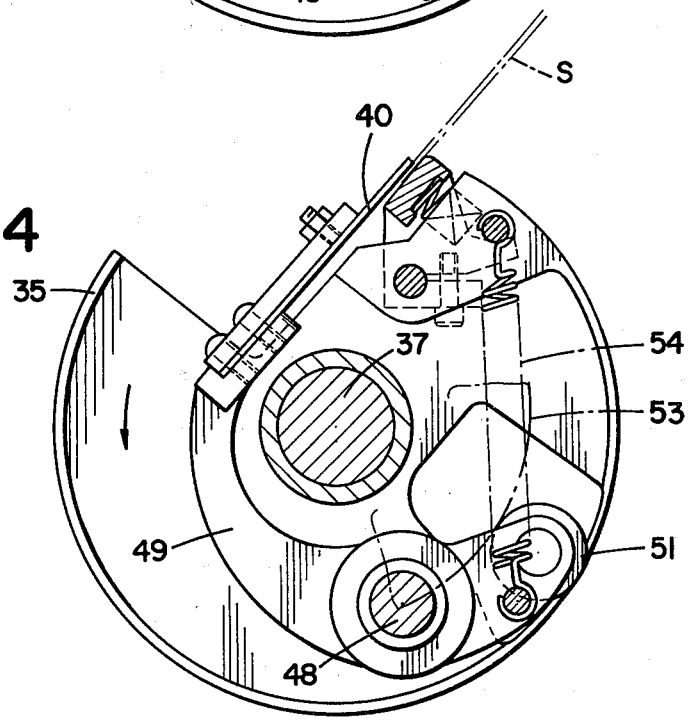
FIG. 4 is a view on the line 4—4 of FIG. 2.
Figure 5:
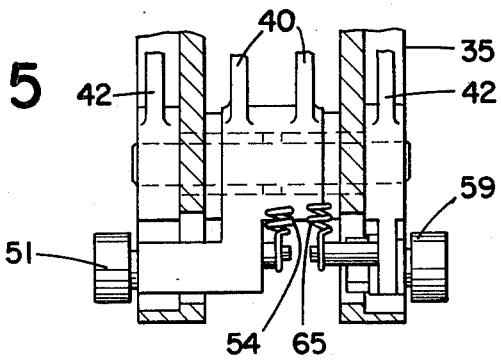
FIG. 5 is a view partially in section of the grippers on the transfer drum.

A transfer drum or cylinder 35 is positioned adjacent the extractor drum 15 and is mounted upon a shaft 37 for rotation in a counterclockwise direction as viewed in FIG. 1. As shown in FIG. 2, transfer drum 35 includes two segments 36 and 38 spaced apart on shaft 37. Transfer drum 35 carries two sets of grippers 40 and 42 and a gripper stop 44 which is shown in FIGS. 2 to 5. Grippers 40 are inner or primary grippers positioned between segments 36 and 38 while grippers 42 are outer or secondary grippers. Primary grippers 40 are, as shown in FIG. 2, slightly longer than grippers 42 which enables them to grip both sides of the cut edge of a signature while secondary grippers 42 grip only the longer overlapping side. Grippers 40 are mounted upon a pivot shaft 48 by means of an arm 49 which also carries a cam roller 51. As grippers 40 rotate with transfer drum 35, cam roller 51 follows a stationary cam 53 causing gripper arm 49 to pivot about shaft 48 to open and close the grippers 40 on the gripper stop 44. The primary grippers are biased to the closed position by a spring 54.

Similarly, secondary grippers 42 are mounted on pivot shaft 48 by means of an arm 57 which also carries a cam roller 59. As grippers 42 rotate with transfer drum 35, cam roller 59 follows a stationary secondary gripper cam 63 causing the arm 57 to pivot about shaft 48 to open and close the secondary grippers on gripper stop 44. The secondary grippers are biased to the closed position by means of a spring 65. The stationary cams 53 and 63 for the primary and secondary grippers, respectively, are held stationary by means of arms 69 and 70 which contact a stop bar 72 as shown in FIG. 2.

Figure 6:
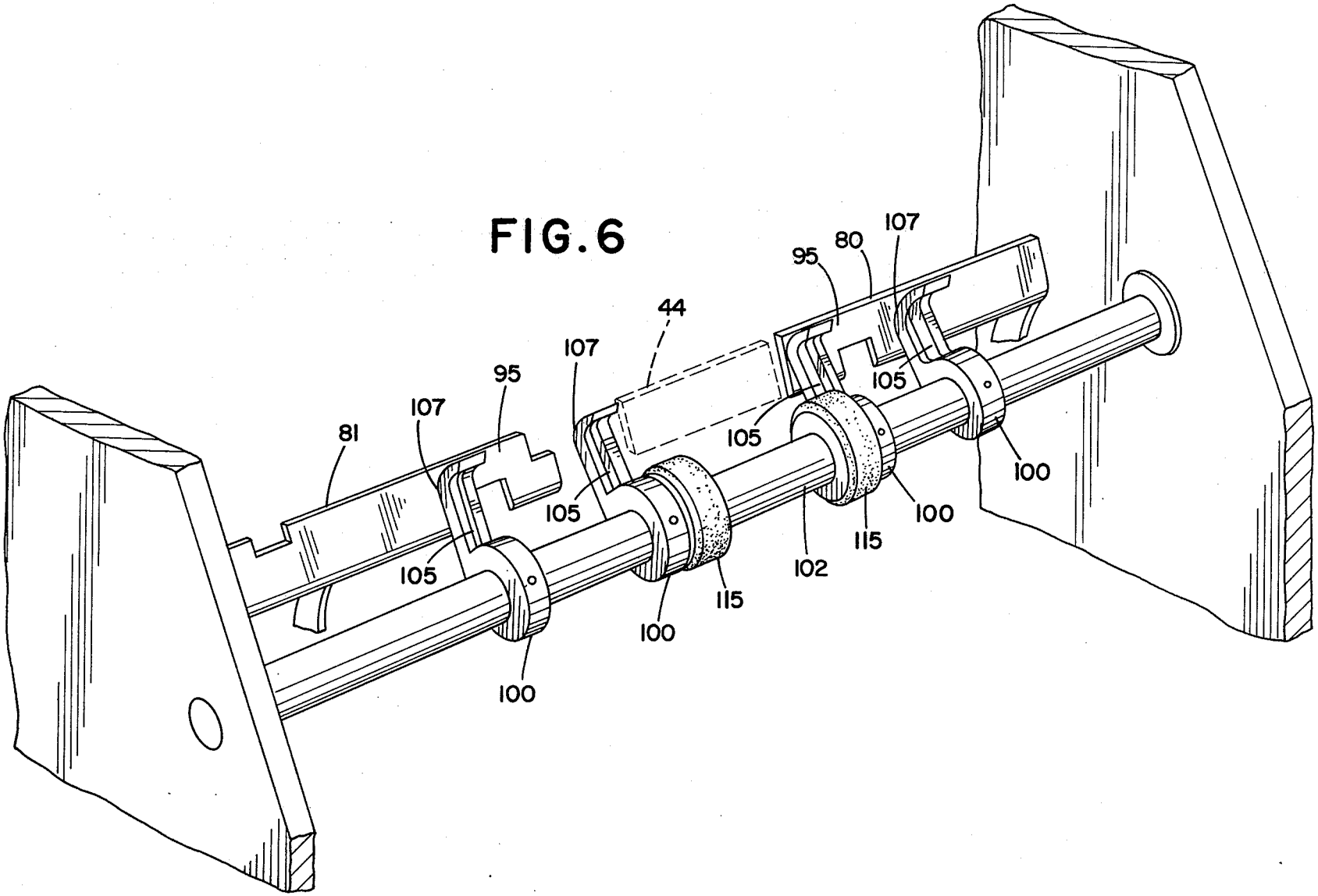
FIG. 6 is a perspective view of the rotary vanes and dippers generally in the direction of the arrows 6—6 of FIG. 1.

As shown in FIGS. 1, 2 and 6, a set of dippers 80, 81 is mounted on a shaft 85 adjacent the extractor drum 15 and transfer drum 35. The dippers are oscillated about shaft 85 by a cam 87 which is mounted on shaft 37 and rotatable with transfer drum 35. Cam 87 contacts a cam roller 90 which is mounted on dipper 81. The cam roller is maintained in contact with cam 87 by a spring arm 92. Each dipper 80, 81 has a flat signature supporting face 95. As transfer drum 35 rotates toward its position shown in FIG. 1, dippers 80 and 81 are moved in a counterclockwise path to contact the lower cut edge of a signature S held in the stop 31 on extractor drum 15 and move it to the position shown in FIG. 1. In this position, the lower edge of the signature S can be securely gripped by grippers 40 and 42.

A plurality of rotary wiper vanes 100, four being shown, are mounted on a shaft 101 positioned above and parallel to shaft 37 of transfer drum 35. Each vane 100 has an arm portion 105 and an arcuate wiping portion 107. The position of shaft 102 and the length of vane arm 105 are chosen so that the arcuate surface 107 of the vane may wipe across the signature supporting surface 95 of the dippers 80, 81 with a very slight clearance when the dippers are in the signature end supporting position shown in FIG. 1. The vanes 100 are positioned on shaft 102 so that, as the dippers are in the position shown in FIG. 1 supporting the signature S, the vanes 100 wipe the signature end smoothly onto the dipper surface 95 to eliminate any bounce or tendency for the signature end to curl upwardly. The vanes then continue to rotate through the cutout portion 110 in the periphery of transfer drum 35 and out of the path of signature S.

Simultaneously with or very shortly after vanes 100 have wiped the end of signature S onto dipper surface 95, transfer drum 35 has rotated to the position where gripper stops 44 are substantially coplanar with dipper surface 95 supporting the lower end of signature S. The grippers 40 and 42 are closed at this time to grip the signature and begin to pull it away from extractor drum 15.

Meanwhile, vanes 100 have rotated away from the vicinity of signature S. Grippers 40 and 42 carry the signature and as transfer drum 35 rotates the signature is moved into the path $S^1$ through the nip between a friction roller 115 mounted on shaft 102 and transfer drum 35. As transfer drum 35 continues to rotate cam 53 for the primary grippers 40 causes those grippers to release their hold on the signature which is then gripped only on the longer side by secondary grippers 42.

The signature is then carried into the nip between an opener drum 120 and the transfer drum 35. As the opener drum 120 rotates in the direction of the arrow in FIG. 1, a cam 122 operates a gripper 125 on the opener drum and causes it to grip the shorter side of the signature passing through the nip. As the opener and transfer drum continue to rotate the sides of the signature are spread and the signature is dropped on a saddle 128.

During the transfer and opening of signatures S rotary vanes 100 are positioned away from the signature to permit a smooth path of transfer for the signature. Further, the wiping of the lower end of the signature onto the dipper surface 95 by the vanes insured a secure and proper grip by gripper 40 and 42 with no curls or folds in the gripped portion to cause paper jams.

To summarize the operation, transfer drum 35, opener drum 120 and rotary wiper vane 100 rotate through one complete revolution for every one-half revolution of extractor drum 15. Each set of grippers 16 on extractor drum 15 grip the folded edge of a signature in hopper 11, extract the signature from the hopper and move it to the stop 31. The signature is positioned at that point with its lower end suspended vertically downward from the point of tangency with extractor drum 15. The longer half of the signature is in contact with extractor drum 15 and the shorter side away from it. Dippers 80, 81 are rotated counterclockwise about shaft 85 so that its front face 95 engages the lower cut edge of the signature and moves it in the direction of the transfer drum 35. At that point rotary wiper vanes 100 wipe downwardly across the lower end of the signature as it is being supported on the front face of the grippers to smooth and flatten the signature.

Immediately thereafter, the primary and secondary grippers 40 and 42 associated with transfer drum 35 have rotated to a position such that gripper stop 44 is coplanar with the signature supporting surface of dipper 50. The grippers 40 and 42 are thereupon closed upon the stop 44 and grip the lower cut edge of the signature with the primary grippers 40 gripping the signature above the lap and the secondary grippers gripping only the longer side of the signature as described above.

In the meantime, rotary wiper vanes 100 are moving through cut out portion 110 of transfer drum 35 and away from the path of the signature. The dippers 80, 81 are retracted and the signature is pulled by grippers 40 and 42 around the periphery of the transfer drum and into a path which includes the nip between the periphery of transfer drum 35 and the friction rollers 115. The signature is then pulled into the nip between transfer drum 35 and opener drum 120 at which point the primary grippers 40 release the signature. As the signature descends through the nip between the transfer drum and opener drum the shorter free side of the signature is gripped by grippers 125 on the opener drum. The two halves of the signature is carried around the respective peripheries of the opener drum and the transfer drum and the signature is opened and drops onto a saddle to be carried away and combined with other signatures in a known manner.

What is claimed is:

1. A sheet material handling device comprising a rotatable extractor drum for gripping and carrying a signature from a stack of signatures in a first signature path about the periphery of said extractor drum, stop means for providing a stop position for the signature moved by said extractor drum, a rotatable transfer drum for moving the signature from said stop position through a second signature path, the signature having a lower edge which extends toward said transfer drum when the signature is disposed in the stop position, gripper means rotatable with said transfer drum for gripping the lower edge of the signature as the transfer drum is rotated and when the signature is in said stop position, a dipper, dipper mounting means for supporting said dipper for oscillation toward and away from the lower edge of the signature, a wiper vane, said wiper vane and dipper having respective surfaces engageable with opposite surface portions of the lower edge of the signature to position the lower edge of the signature in a position to be gripped by said gripper means, and means for rotating said wiper vane in a path adjacent said dipper to a location spaced away from said second signature path to locate said wiper vane out of engagement with the signature as the signature is moved through at least part of said second signature path and back into a location to engage a surface portion of another signature being handled.

2. The device as claimed in claim 1 wherein said wiper vane includes an arcuate wiping surface.

3. The device as claimed in claim 1 wherein said wiper vane and said transfer drum rotate in paths which overlap and said transfer drum has cut out portions to permit passage of said wiper vane.

4. The device as claimed in claim 1 including a plurality of said wiper vanes spaced apart for simultaneously wiping the edge of said signature at a plurality of positions.

5. The device as claimed in claim 1 further comprising a roller mounted for rotation on said wiper mounting means in a path of smaller diameter than said wiper vane, said roller forming a nip with said transfer drum for passage of a signature after said wiper vane has rotated away from said signature.

6. A sheet material handling device as defined in claim 1 wherein said respective surfaces having a facing relationship in one location in the path of movement of said wiper vane, and said means for rotating said wiper vane in a direction toward said position wherein the signature is to be gripped from said facing relationship.

* * * * *